United States Patent [19]

Bailey

[11] 4,442,768

[45] Apr. 17, 1984

[54] CAN CRUSHING APPARATUS

[76] Inventor: John R. Bailey, 3735 Geraghty Ave., Waukegan, Ill. 60085

[21] Appl. No.: 344,514

[22] Filed: Feb. 1, 1982

[51] Int. Cl.[3] ..... B30B 9/32

[52] U.S. Cl. ..... 100/233; 100/295; 100/902

[58] Field of Search ..... 100/902, 233, 295

[56] References Cited

U.S. PATENT DOCUMENTS

| | | | |
|---|---|---|---|
| 2,161,931 | 6/1939 | Pattison | 100/902 X |
| 2,373,057 | 4/1945 | Shinn | 100/902 X |
| 2,446,898 | 8/1948 | Alvarez | 100/902 X |
| 2,466,907 | 4/1949 | Nadolny et al. | 100/902 X |
| 2,603,271 | 7/1952 | Heymers | 100/902 X |
| 2,614,604 | 10/1952 | Coffey | 100/902 X |
| 2,800,160 | 7/1957 | Wilson et al. | 100/902 X |
| 3,776,129 | 12/1973 | Carlson | 100/902 X |
| 3,948,164 | 4/1976 | Pobuda et al. | 100/902 X |
| 3,980,015 | 9/1976 | Woodard | 100/902 X |
| 4,208,961 | 6/1980 | Okajima | 100/902 X |
| 4,228,734 | 10/1980 | Parrish | 100/902 X |
| 4,333,395 | 6/1982 | Kurtz | 100/902 X |
| 4,333,396 | 6/1982 | Longnecker | 100/902 X |
| 4,393,765 | 7/1983 | Accettura | 100/233 X |

FOREIGN PATENT DOCUMENTS

| | | | |
|---|---|---|---|
| 1156139 | 6/1969 | United Kingdom | 100/902 |

*Primary Examiner*—Billy J. Wilhite

*Attorney, Agent, or Firm*—Wood, Dalton, Phillips, Mason & Rowe

[57] ABSTRACT

A method of and apparatus for crushing cans, such as aluminum cans, for facilitated further handling. The apparatus is adapted for crushing the can longitudinally to a partially crushed configuration defined by a collapsed cylindrical sidewall, a bottom wall extending substantially perpendicularly to the axis of the sidewall, and a top wall extending at an acute angle to the axis. The apparatus is further arranged to permit manipulating the partially crushed can to a different disposition wherein the partially crushed can is crushed to a final configuration defined by a further collapsed cylindrical sidewall thereof, a bottom wall extending substantially perpendicularly to the axis of the further collapsed sidewall, and a top wall reversely repositioned at a displacement angle to the original acute angle of the partially crushed can. In the illustrated embodiment, the displacement angle is at least equal to the acute angle so that the top wall is reversely repositioned from the original acute angle of the partially crushed can to at least a disposition perpendicular to the axis. In the illustrated embodiment, the apparatus includes a base and a lever pivotally interconnected for manipulation of a handle portion of the lever in effecting the above described crushing operation. The base is provided with a recess for effectively retaining the can during the partial crushing operation. The lever is provided with an annular recess for effective engagement with the top wall of the can in effecting the partial crushing operation.

14 Claims, 7 Drawing Figures

FIG. 1
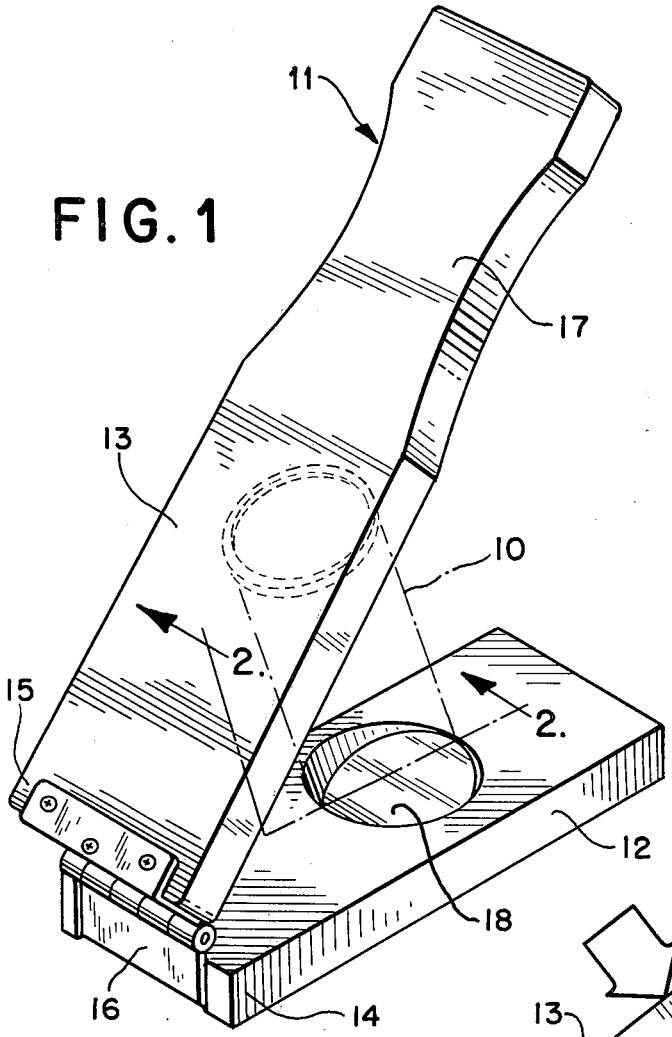
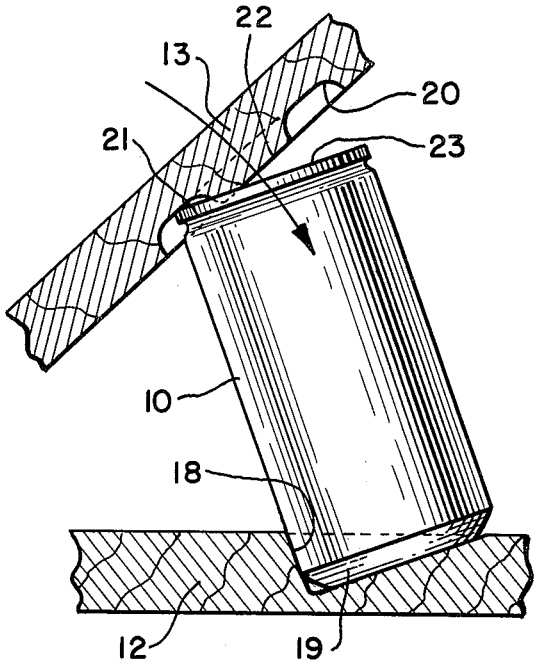
FIG. 2
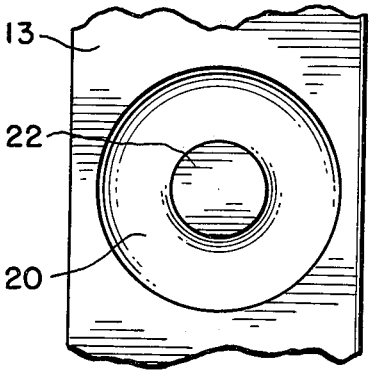
FIG. 3
FIG. 4
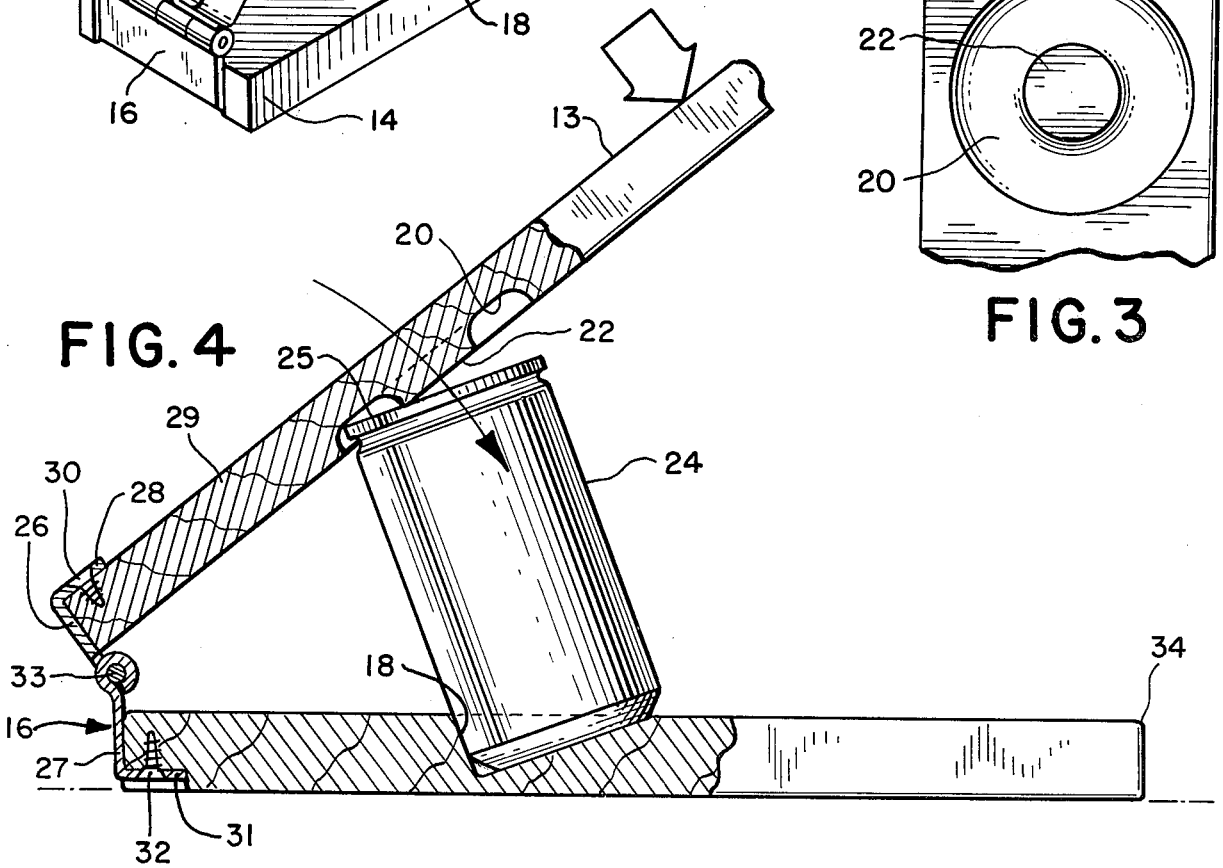

CAN CRUSHING APPARATUS

BACKGROUND OF THE INVENTION

1. Field of the Invention

This invention relates to can crushing, and in particular to an apparatus for crushing cans, such as aluminum cans, for facilitated disposal.

2. Description of the Background Art

A substantial number of different devices have been developed for crushing cans and the like. One common form of such can crusher comprises means for crushing the can transversely to the longitudinal axis thereof. One such device is illustrated in U.S. Pat. No. 2,800,160 of Alvin C. Wilson et al. As shown therein, the can flattening device includes a base to which is pivotally connected a lever having at its distal end a manipulating handle. The base is provided with a cleat which supports the can to be crushed, with its longitudinal axis parallel to the pivot axis. The lever is swingable toward the base to a final crushed can disposition which is limited by an adjustable stop on the base.

A number of devices which crush the cans longitudinally have also been developed heretofore. One such device is illustrated in U.S. Pat. No. 3,980,015 of Hubert R. Woodard. As shown therein, the can is placed between a pair of spaced crushing plates. The plates are pivotally mounted in spaced relationship to each other on a base and are provided with handles. The handles permit the crushing plates to be swung about the opposite ends of the can so as to effectively crush the can effectively transversely to the longitudinal axis thereof.

Another example of a can crusher for crushing cans is illustrated in U.S. Pat. No. 4,228,734 of Ernest H. Parrish. As shown therein, the can crusher is provided with a crushing anvil which is urged in a direction parallel to the axis of the can held on a base by means of a lever and linkage arrangement. The entire crushing action is effected rectilinearly.

SUMMARY OF THE INVENTION

The present invention comprehends an improved apparatus for can crushing.

More specifically, the invention comprehends the provision of a novel method of crushing a can comprising the steps of crushing the can longitudinally to a partially crushed configuration defined by a collapsed cylindrical sidewall, a bottom wall extending substantially perpendicular to the axis of the cylindrical sidewall, and a top wall extending at an acute angle to the axis, manipulating the partially crushed can to a different disposition, and crushing the partially crushed can in the different disposition to cause the can to have a final crushed configuration defined by a further collapsed cylindrical sidewall, a bottom wall extending substantially perpendicularly to the axis of the further collapsed sidewall, and a top wall reversely repositioned at a displacement angle to the acute angle at least equal to the acute angle.

In the illustrated embodiment, the top wall of the can is disposed in the final crushed configuration perpendicularly to the axis of the further collapsed sidewall or selectively beyond the perpendicular configuration to have an obtuse angle to the axis of the further collapsed sidewall as a result of the repositioning of the top wall from the acute angle disposition through the perpendicular disposition to the final obtuse angle disposition.

In the illustrated embodiment, the partially crushed can is removed from a first portion of the apparatus wherein it is held during the partial crushing operation to a different portion of the apparatus wherein it is brought to the final fully crushed disposition.

More specifically, the can crusher of the present invention includes a base having a pivot portion and a recess for receiving at least a portion of one end of a can to be crushed, a crusher lever having a pivot portion, a handle portion, and a recess intermediate the lever pivot portion and handle portion for receiving at least a portion of the opposite end of the can to be crushed, pivot means pivotally connecting the pivot portions of the base and lever for pivotal movement of the lever by forceful urging of the handle portion thereof from a can receiving position wherein a can to be crushed may be disposed with its ends received in the base and lever recesses respectively, to a partial crushed position wherein the can is longitudinally crushed to a preselected longitudinal thickness, and surface means on the base and lever respectively intermediate the recesses and the pivot means for receiving the partially crushed can therebetween for completion of the crushing of the can to a final desired crushed thickness as a result of further pivotal movement of the lever toward the base.

In the illustrated embodiment, the pivot means spaces the lever pivot portion a preselected distance from the base pivot portion slightly greater than the final desired crushed thickness.

In the illustrated embodiment, the lever recess is made annular to provide improved dimpling action in the crushing of the can.

In the illustrated embodiment, the base recess is inclined to the base upper surface.

The inclination of the can in the base recess is such as to cause the top of the can to engage the annular recess of the lever at a point spaced from the pivot means a distance similar to the spacing of the spaced recess therefrom.

Thus, the method and apparatus of the present invention are extremely simple and economical while yet providing a highly improved can crushing operation.

BRIEF DESCRIPTION OF THE DRAWING

Other features and advantages of the invention will be apparent from the following description taken in connection with the accompanying drawing wherein:

FIG. 1 is a perspective view illustrating a first step in the use of the apparatus in effecting the crushing of a can;

FIG. 2 is a fragmentary vertical section taken substantially along the line 2—2 of FIG. 1;

FIG. 3 is a fragmentary bottom plan view of the lever illustrating the facial configuration of the lever can-receiving groove;

FIG. 4 is a vertical section of the apparatus at the initiation of a can crushing operation wherein the can is a can having a slightly shorter length than that of FIGS. 1 and 2;

DESCRIPTION OF THE PREFERRED EMBODIMENT

Figure 5:
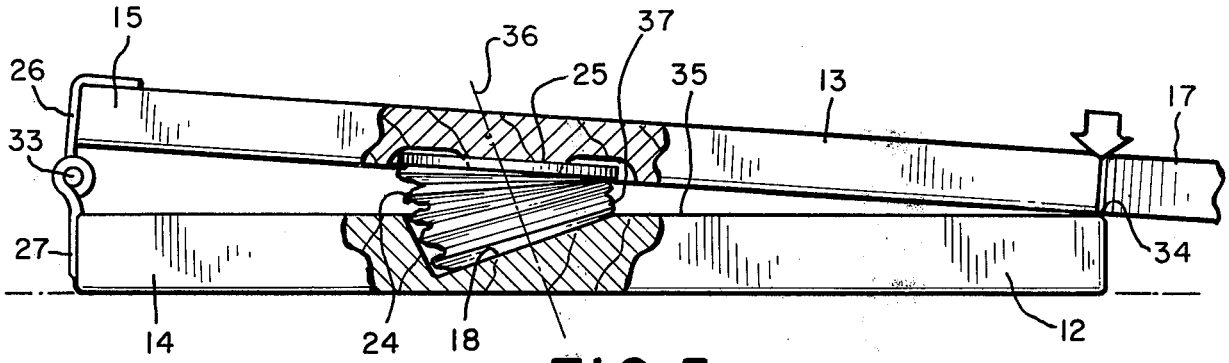
FIG. 5 is a fragmentary vertical section similar to that of FIG. 4 but illustrating the arrangement of the apparatus as upon completion of the partial crushing operation.

In the illustrative embodiment of the invention as disclosed in the drawing, a can 10 to be crushed is placed in a can crusher apparatus generally designated 11, which is suitably manipulated to effect a longitudinal crushing of the can in a novel two-step operation.

As shown in FIG. 1, the can crusher includes a base 12 and a lever 13 between which the can is crushed. Base 12 defines a rear pivot portion 14 and lever 13 defines a rear pivot portion 15, which are pivotally connected by a pivot hinge 16, whereby the lever is pivotally swung relative to the base in effecting the can crushing operation. As further illustrated in FIG. 1, lever 13 includes a distal handle portion 17 which is grasped by the user in effecting the crushing operation.

As further illustrated in FIG. 2, base 12 is provided with an upwardly opening recess 18 for receiving the bottom end 19 of the can and effectively retaining it against displacement relative to the base during the can crushing operation. As further illustrated in FIG. 2, lever 13 is provided with an annular recess 20 in which an upper corner 21 of the can is initially received for effectively retaining the can in suitable disposition to initiate the can crushing operation.

The annular recess 20 defines a central projecting portion 22 which tends to dimple the upper end 23 of the can during the crushing operation.

The apparatus is adapted for use with cans of different heights, and in FIG. 4, the apparatus is illustrated in association with a can 24 having a height somewhat less than that of can 10. The functioning of the apparatus will be described herefollowing with respect to can 24, it being understood that the operation is generally similar for cans of different heights, such as can 10, etc.

As shown in FIG. 4, the upper corner 25 of can 24 is received within the annular recess 20 of lever 13 generally similarly to the reception of corner 21 of can 10 therein. As illustrated in FIG. 4, pivot hinge 16 is defined by a pair of hinge members 26 and 27. Hinge member 26 defines a turned end 28 secured to the outer surface 29 of lever 13 as by suitable threaded screws 30, and hinge member 27 includes a turned end 31 secured to the bottom portion of the base by suitable threaded means 32. The pivot members 26 and 27 are interconnected by a conventional hinge pin 33.

As illustrated in FIG. 4, the extension of hinge members 26 and 27 is such as to space the base pivot portion 14 from pivot portion 15 when the lever 13 is pivotally swung fully in the clockwise direction shown in FIG. 5 to the position wherein handle 17 engages the distal end 34 of base 12. Thus, as shown in FIG. 5, lever 13 extends at a small angle to the flat upper surface 35 of base 12 in the juxtaposed disposition of the lever relative to the base.

As shown in FIG. 5, the upper end 25 of the can 24 is caused to extend at an acute angle to the axis 36 of the cylindrical sidewall 37 of the partially crushed can when the lever is brought to the fully pivoted position wherein handle 17 contacts base portion 34. Thus, as shown in FIG. 5, can 24 is caused to be in a partially crushed disposition as a result of this initial step in the crushing operation.

Figure 6:
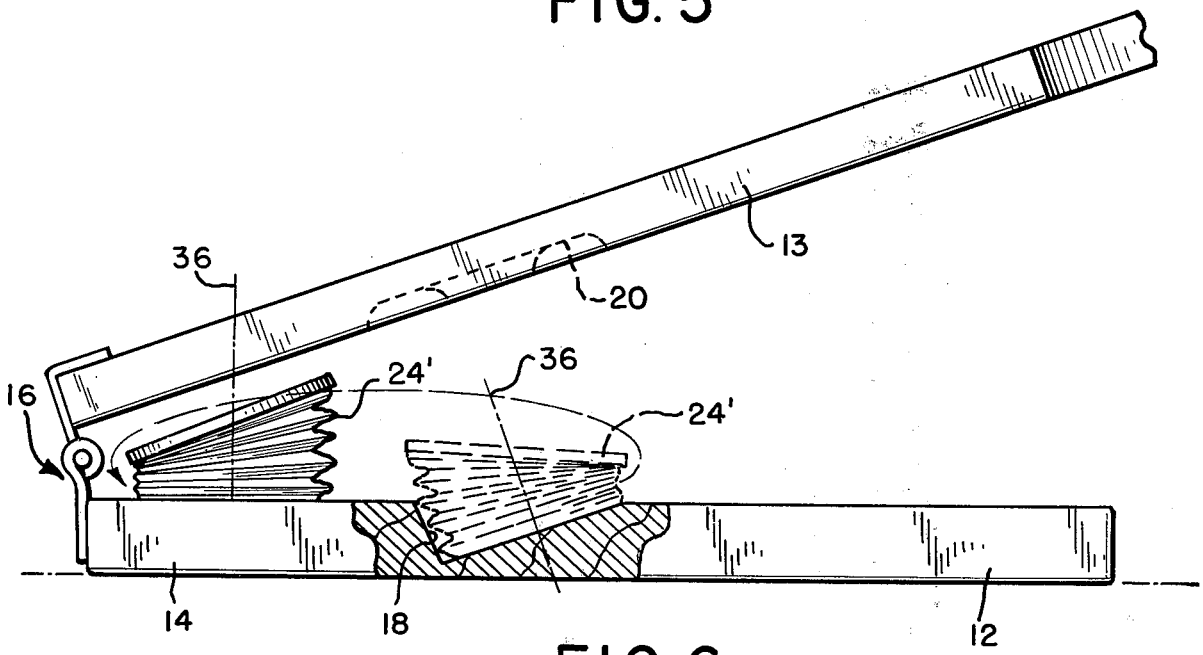
FIG. 6 is an elevation illustrating the repositioning of the partially crushed can to a disposition for effecting the final crushing thereof.

As shown in FIG. 6, the next step in effecting the full crushing of the can comprises a step of removing the partially crushed can 24', turning it approximately 180° about the axis 36 thereof and placing the turned can on the base adjacent pivot portion 14 thereof intermediate the base recess 18 and pivot hinge 16. This is done, as shown in FIG. 6, with the lever 13 raised from base 12.

The final step of crushing of can 24' is then effected by the user depressing the handle portion 17 into engagement with base tip 34. As a result, the partially crushed can is further crushed to a final crushed configuration 38 wherein the top wall 23 of the can is disposed at an angle to the axis 36 of the cylindrical sidewall 37 which is at an obtuse angle to the axis as compared to the acute angle of the top wall in the partially crushed can 24'.

As will be obvious to those skilled in the art, if desired, the handle 17 may be retained in somewhat spaced relationship to the base end 34 in either or both of the crushing operations. Thus, illustratively, the handle may be brought to a position substantially parallel to the base only in effecting the partial crushing operation. However, as will be obvious to those skilled in the art, even with such limited pivotal movement of the handle, the top wall is disposed at an acute angle to the axis of the sidewall, although to a somewhat lesser extent. If it is desired to maintain the top wall parallel to the bottom wall in the final crushed configuration, the user merely brings the handle again parallel to the upper surface of the base in the final crushing step so that lever end portion 15 is disposed parallel to base end portion 14, with the opposite ends of the crushed can then being parallel to each other.

Figure 7:
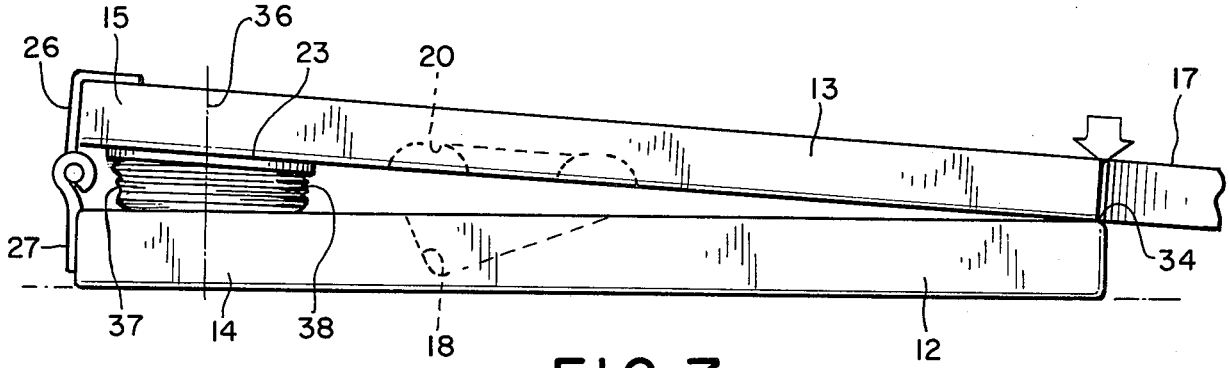
FIG. 7 is a fragmentary vertical section illustrating the arrangement of the apparatus and can as upon final crushing thereof.

It should be noted, however, that inasmuch as handle 17 extends beyond the distal end 34 of the base, the user's fingers may be readily accommodated beneath the projecting end of the handle even when the handle engages the base end 34, so that facilitated manipulation of the apparatus in effecting the full compaction operation illustated in FIG. 7 is safely and easily carried out.

In one improved form of the apparatus, the hinge 16 was arranged to space the lever portion 15 approximately $\frac{5}{8}''$ from the base portion 14. The base recess was inclined at an angle of approximately 20° to the upper surface 35 of the base, and the axis thereof was spaced approximately $5\frac{1}{2}''$ from the pivot means. The length of the lever 13, including handle portion 17 was approximately four times the spacing of the axis 36 from the pivot means. The base and lever were formed of wood. This apparatus was used to crush a large number of cans and functioned perfectly in retaining the cans positively during the crushing operation and effecting the partial and final crushing operations with facility and high speed.

The foregoing disclosure of specific embodiments is illustrative of the broad inventive concept comprehended by the invention.

I claim:

1. A can crusher comprising:

a base having a pivot portion and a recess for receiving at least a portion of one end of a can to be crushed;

a crusher lever having a pivot portion, a handle portion, and a recess intermediate said lever pivot portion and handle portion for receiving at least a portion of the opposite end of the can to be crushed;

pivot means pivotally connecting said pivot portions of the base and lever for pivotal movement of the lever by forceful urging of the handle portion thereof from a can receiving position wherein a can to be crushed may be disposed with its ends received in said base and lever recesses respectively, to a partial crush position wherein the can is longitudinally crushed to a preselected longitudinal thickness wherein the plane of the top of the can is disposed at a partial crush angle to the plane of the bottom of the can; and planar surface means on said base and lever respectively intermediate said recesses and said pivot means for receiving the partially crushed can therebetween with said top plane of the partially crushed can directed downwardly toward said pivot means, the angle of said surface means of said lever extending at an angle toward said pivot means to said surface means of the base which is less than said partial crush angle when the lever is pivoted to engage the top of the partially crushed can so disposed between said surface means for completion of the crushing of the entire can to a final desired crushed thickness as a result of further pivotal movement of the lever toward the base.

2. The can crusher of claim 1 wherein said pivot means compromises means for spacing the lever pivot portion a preselected distance from the base pivot portion, said preselected distance being slightly greater than said final desired crushed thickness.

3. The can crusher of claim 1 wherein said lever recess is annular.

4. A can crusher comprising:

a base having a pivot portion and a recess for receiving at least a portion of one end of a can to be crushed;

a crusher lever having a pivot portion, a handle portion, and a recess intermediate said lever pivot portion and handle portion for receiving at least a portion of the opposite end of the can to be crushed;

pivot means pivotally connecting said pivot portions of the base and lever for pivotal movement of the lever by forceful urging of the handle portion thereof from a can receiving position wherein a can to be crushed may be disposed with its ends received in said base and lever recesses respectively, to a partial crush position wherein the can is longitudinally crushed to a preselected longitudinal thickness; and surface means on said base and lever respectively intermediate said recesses and said pivot means for receiving the partially crushed can therebetween for completion of the crushing of the can to a final desired crushed thickness as a result of further pivotal movement of the lever toward the base, said base recess defining an axis inclined at an acute angle to the base.

5. The can crusher of claim 1 wherein said base recess is cylindrical.

6. The can crusher of claim 1 wherein said pivot means spaces said pivot portions of the base and lever apart a distance of approximately $\frac{5}{8}$".

7. The can crusher of claim 4 wherein said base recess is inclined at an angle of approximately 20° to the surface of the base.

8. The can crusher of claim 4 wherein said base recess is inclined at an angle of approximately 20° to the surface of the base and defines a center spaced approximately $5\frac{1}{2}$" from the pivot means.

9. The can crusher of claim 1 wherein said handle portion extends to a distal end spaced from said pivot means a distance approximately four times the spacing of the center of said lever recess from the pivot means.

10. The can crusher of claim 1 wherein said base and lever recesses are spaced substantially equidistantly from said pivot means.

11. The can crusher of claim 1 wherein at least one of said base and lever recesses defines a central projection for retaining the center of the abutted can end during the partial crushing operation.

12. The can crusher of claim 1 wherein said lever has a length from said pivot means greater than the length of said base from said pivot means.

13. A can crusher comprising:

a base having a pivot portion and a recess for receiving at least a portion of one end of a can to be crushed;

a crusher lever having a pivot portion, a handle portion, and a recess intermediate said lever pivot portion and handle portion for receiving at least a portion of the opposite end of the can to be crushed;

pivot means pivotally connecting said pivot portions of the base and lever for pivotal movement of the lever by forceful urging of the handle portion thereof from a can receiving position wherein a can to be crushed may be disposed with its ends received in said base and lever recesses respectively, to a partial crush position wherein the can is longitudinally crushed to a preselected longitudinal thickness wherein a portion of the can is substantially fully crushed; and surface means on said base and lever respectively intermediate said recesses and said pivot means for receiving the partially crushed can therebetween for completion of the crushing of the entire can to a final desired crushed thickness as a result of further pivotal movement of the lever toward the base, said base recess being inclined at an angle to said base.

14. The can crusher of claim 13 wherein said surface means defines a substantially planar surface.

* * * * *